US011757222B1

(12) United States Patent
Mann et al.

(10) Patent No.: US 11,757,222 B1
(45) Date of Patent: Sep. 12, 2023

(54) COMBINED PIN AND CARD EDGE CONNECTOR

(71) Applicant: INTERNATIONAL BUSINESS MACHINES CORPORATION, Armonk, NY (US)

(72) Inventors: Phillip V. Mann, Rochester, MN (US); Tyler Jandt, Austin, TX (US); Sandra J. Shirk/Heath, Rochester, MN (US); Tyler Smith, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 17/805,898

(22) Filed: Jun. 8, 2022

(51) Int. Cl.
*H01R 12/72* (2011.01)

(52) U.S. Cl.
CPC ..... *H01R 12/727* (2013.01)

(58) Field of Classification Search
CPC ..... H01R 12/727; H01R 12/722; G01R 31/2808; H05K 1/141
See application file for complete search history.

(56) References Cited

U.S. PATENT DOCUMENTS 4,936,785 A * 6/1990 Krug ..... G06F 13/409 439/59
5,024,609 A 6/1991 Piorunneck
6,710,614 B1 * 3/2004 Wark ..... H01R 12/83 324/757.02
6,796,843 B1 * 9/2004 Ryan ..... H01R 12/721 439/59
6,814,583 B1 11/2004 Young
6,955,551 B2 10/2005 Yamamoto
8,182,289 B2 5/2012 Stokoe
8,830,683 B2 * 9/2014 Cong ..... G06F 1/189 361/679.01
9,331,407 B2 5/2016 Laurx et al.

FOREIGN PATENT DOCUMENTS

WO 2016151562 A1 9/2016

OTHER PUBLICATIONS

Villien, P., "Card-Edge Connector Reliability ." Published Jan. 1984. 6 pages. In Electrocomponent Science and Technology 11(2). Published by Research Gate. DOI:10.1155/APEC.11.159.

* cited by examiner

*Primary Examiner* — Vanessa Girardi
(74) *Attorney, Agent, or Firm* — Matthew Zehrer

(57) ABSTRACT

To provide for high-performance communicational throughput between electronic systems, a high-performance connector pair is disclosed. The connector pair includes a pin receptacle and card edge (PRCE) connector that may be seated or connected to a pin and card edge receptacle (PCER) connector. The PRCE connector includes an edge connector, with a plurality of edge connector pads and a pin receptacle connector with a mount region connected to the printed circuit board and a receptacle portion with a plurality of conductive pin receptacles. The PRCE connector further includes a clearance between the edge connector and the receptacle portion. The PCER connector includes a pin and card edge receptacle connector with an edge socket that receives the edge connector and includes a plurality of socket pads. The PCER connector includes further includes a pin socket that receives the receptacle portion with a plurality of pins.

20 Claims, 5 Drawing Sheets

COMBINED PIN AND CARD EDGE CONNECTOR

BACKGROUND

Various embodiments of the present application generally relate to a first electronic device that includes a pin and card edge receptacle (PCER) connector that communicatively and/or electrically connects with a second electronic device that includes a pin receptacle and card edge (PRCE) connector.

SUMMARY

In an embodiment of the present invention, a system is presented. The system includes a first printed circuit board comprising an edge connector comprising a plurality of edge connector pads. The system includes a pin receptacle connector comprising a mount region connected to the printed circuit board and a receptacle portion comprising a plurality of conductive pin receptacles. The system includes a clearance between the edge connector and the receptacle portion. The system further includes a pin and card edge receptacle connector comprising an edge socket that receives the edge connector and comprises a plurality of socket pads, the pin and card edge receptacle connector further comprising a pin socket that receives the receptacle portion and comprises a plurality of pins.

In another embodiment, a computer is presented. The computer includes a first printed circuit board system communicatively connected to a second printed circuit board. The first printed circuit board includes an edge connector comprising a plurality of edge connector pads, a pin receptacle connector comprising a mount region connected to the printed circuit board and a receptacle portion comprising a plurality of conductive pin receptacles, and a clearance between the edge connector and the receptacle portion. The second printed circuit board includes a pin and card edge receptacle connector comprising an edge socket that receives the edge connector and comprises a plurality of socket pads, the pin and card edge receptacle connector further comprising a pin socket that receives the receptacle portion and comprises a plurality of pins.

In another embodiment, another computer is presented. The computer includes a daughter printed circuit card communicatively connected to a mother board. The daughter printed circuit card includes an edge connector with a plurality of edge connector pads, a pin receptacle connector comprising a mount region connected to the printed circuit board and a receptacle portion comprising a plurality of conductive pin receptacles, and a clearance between the edge connector and the receptacle portion. The mother board includes a pin and card edge receptacle connector comprising an edge socket that receives the edge connector and comprises a plurality of socket pads, the pin and card edge receptacle connector further comprising a pin socket that receives the receptacle portion and comprises a plurality of pins.

These and other embodiments, features, aspects, and advantages will become better understood with reference to the following description, appended claims, and accompanying drawings.

Figure 1:
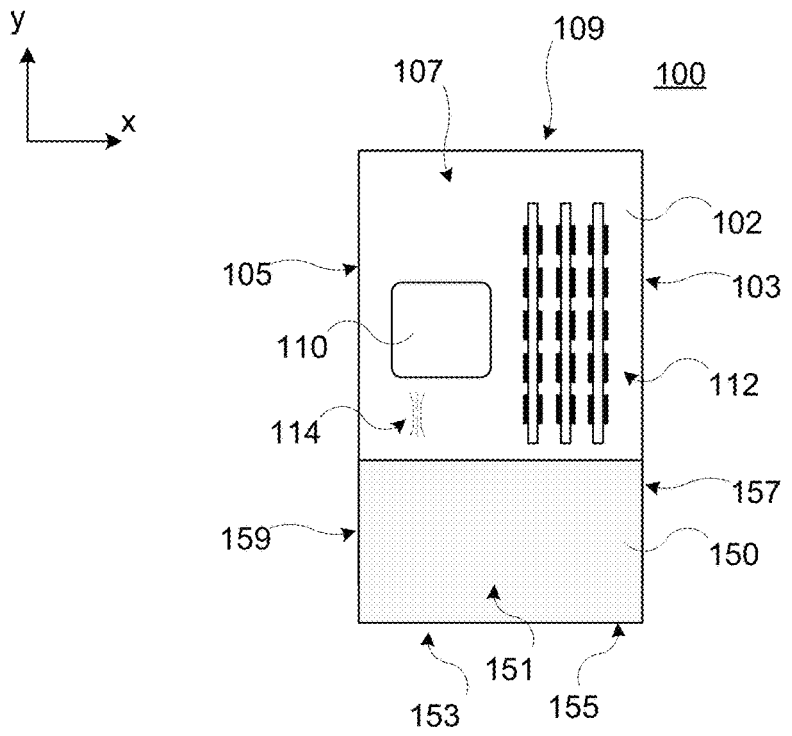
FIG. 1 depicts a planar view of an electrical system that includes PRCE connector, according to one or more embodiments of the present invention.

In accordance with common practice, the various features illustrated in the drawings may not be drawn to scale. Accordingly, the dimensions of the various features may be arbitrarily expanded or reduced for clarity. In addition, some of the drawings may not depict all the components of a given system, method, or device. Finally, like reference numerals may be used to denote like features throughout the specification and Figures.

DETAILED DESCRIPTION

Computers increasingly utilize high performance devices to accomplish computational work. There is an increasing variety of high-performance devices designed to accomplish specific types of computational work. As such, architecture modularity is utilized in some computer architectures to allow for various high-performance devices to be included within a computer to accomplish specific types of computational work associated therewith. For example, a first electronic system, such as a card, that includes a high-performance device may be connected to a second electronic system, to perform computational work associated with the specific high-performance device.

To provide for high-performance communicational throughput between the electronic systems within the computer, a high-performance connector pair is disclosed. The connector pair includes a pin receptacle and card edge (PRCE) connector that may be seated or connected to a pin and card edge receptacle (PCER) connector.

Figure 2:
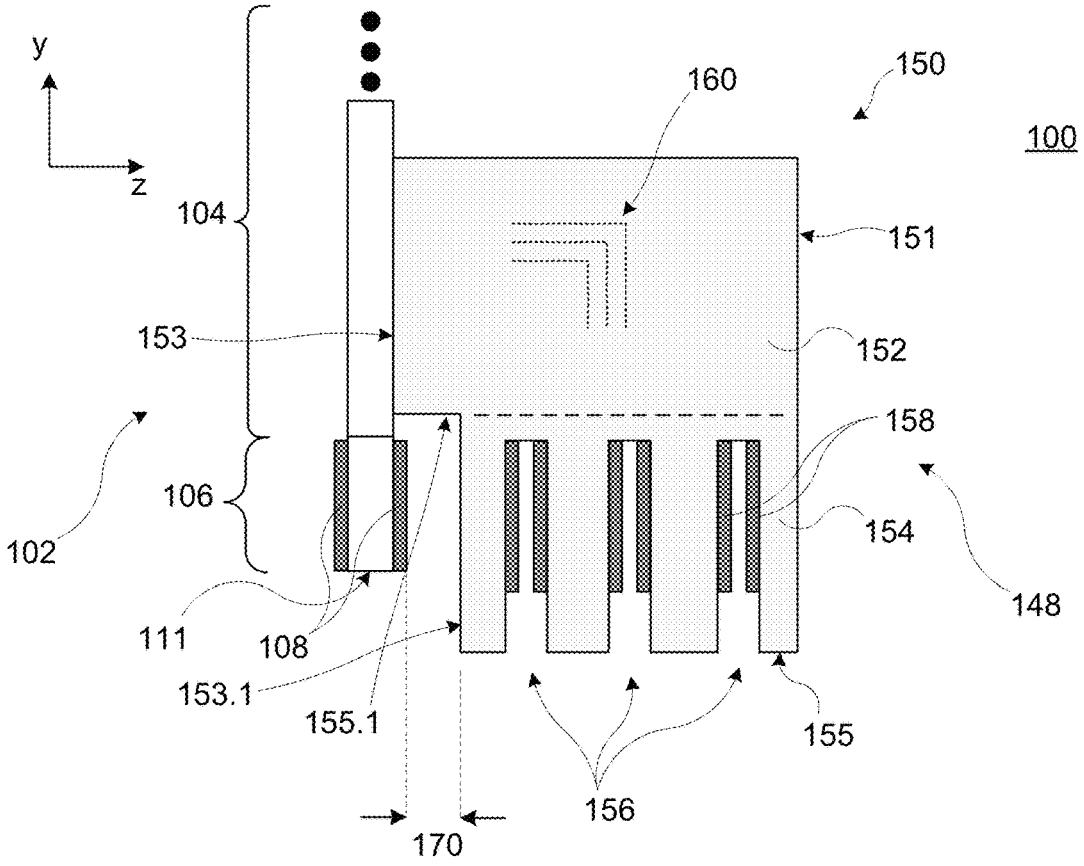
FIG. 2 depicts a cross sectional planar view of a PRCE connector, according to one or more embodiments of the present invention.
Figure 3:
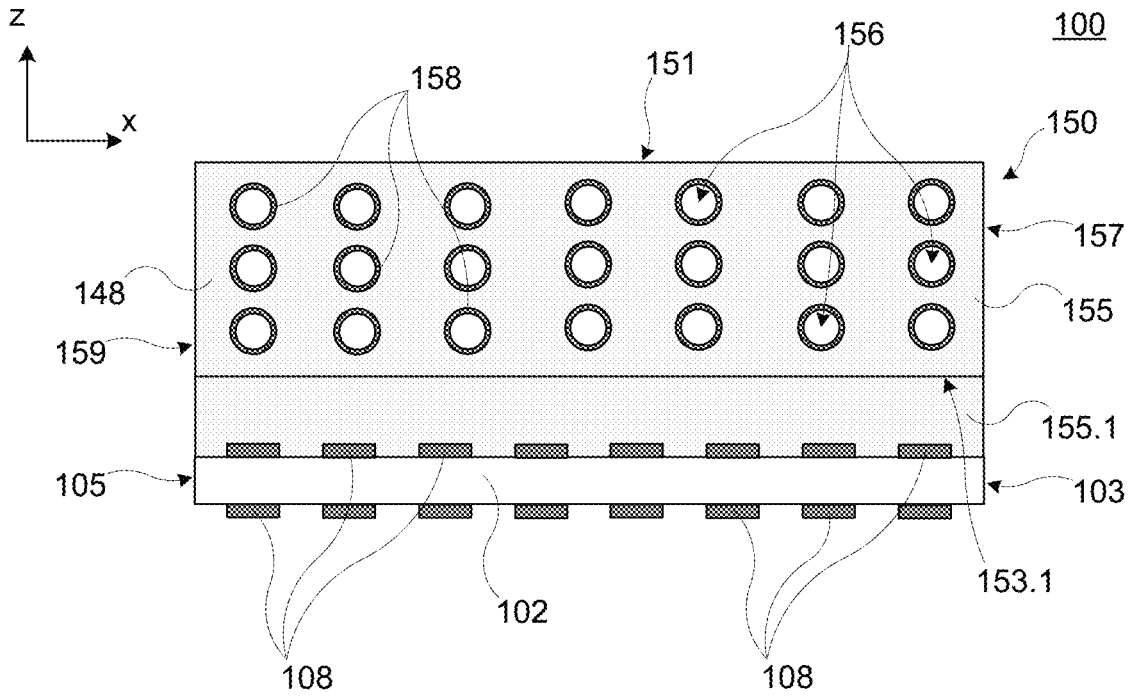
FIG. 3 depicts a planar view of a PRCE connector, according to one or more embodiments of the present invention.

Please refer to FIG. 1, FIG. 2, and FIG. 3 together, which depict different views of electrical system 100 that includes pin receptacle (PR) connector 148 and printed circuit card or board 102, hereinafter referred to as PCB 102, according to one or more embodiments of the present invention.

PCB 102 is a printed circuit card, as is known in the art, and may include alternating conductive layers and insulating layers. Electronic components, such as a processor 110, memory 112, or the like, may be connected to an outer location of PCB 102. For example, respective terminal(s) of the electronic components may be soldered to respective conductive pads of PCB 102. PCB 102 may be a daughter card, adapter card, or the like.

Electrical connections and/or open circuits between the electronic component's terminals are provided by conductive pathways, hereinafter referred to as traces 114, of a conductive layer. For example, one or more traces 114 may electrically connect appropriate landing pads associated with processor 110 with appropriate landing pads associated with memory 112. Trace(s) 114 may be located on the surface of an outer insulating layer, on the surface of an internal insulating layer, etc.

Traces 114 of a particular conductive pathway layer may be a pattern of conductors, similar to wires on a surface, that provides electrical connections on that conductive layer. For adequate electrical isolation, traces 114 formed in the same conductive layer may be spaced apart. The insulating layer(s) between different conductive layers may adequately electrically isolate the conductive layers. Vias, or plated-through holes that extend through one or more appropriate insulating layers, may electrically connect a trace 114 of a first conductive layer with a trace 114 of a different conductive layer.

PCB 102 may mechanically support electronic components, such as processor 110, memory 112 (such as cache memory, system memory, etc.), or the like, using conductive pads in a shape designed to accept the component's terminals, and also electrically connect them using traces 114, conductive planes (voltage plane, etc.), and/or other features etched from the appropriate conductive layer. These electronic components may be included or on PCB 102 to provide both electrical and mechanical connection.

PCB 102 can be single-sided (one conductive layer upon a front surface 107 of a single insulating layer), double-sided (a conductive layer upon front surface 107 and rear surface 109 of a single insulating layer), or multi-layer (outer and inner conductive layers, alternating with one or more insulating layer(s)).

PCB 102 may have the front surface 107, rear surface 109, side surface 103, side surface 105, bottom edge surface 111. The electronic components may be mounted to front surface 107, rear surface 109, or both the front surface 107 and rear surface 109. Similarly, PR connector 148 may be mounted to front surface 107 or rear surface 109. Side surface 103 and/or side surface 105 may be parallel with the yz plane, bottom edge surface 111 may be parallel with the xz plane, front surface 107 and/or rear surface 109 may be parallel with the xy plane.

PCB 102 may include an electronic component region 104 and an edge connector region 106. Electronic component region 104 includes area of front surface 107 and/or rear surface 109 in which electronic components and PR connector 148 may be mounted thereto. Edge connector region 106 includes an edge connector of the PCB 102. Edge connectors may be used for connecting PCB 102 to another PCB. The edge connector is generally plugged in to a socket on the other PCB, thus making the connection. Edge connector includes using conductive pads 108 in a shape designed to accept conductive features of the socket, thus making an electrical connection between the different PCBs. The conductive pads 108 may be gold plated nickel, or other metal, known in the art, to allow for the repeated plugging and unplugging of the edge connector from the socket. To help guide the edge connector into the socket, the edge connector may have a beveled leading edge at bottom edge surface 111 (not shown). The term "edge connector" is defined herein to be the edge portion of PCB 102 consisting of traces 114 connected to pads 108, respectively, that is intended to plug into a matching socket.

Conductive pads 108 can be single-sided (multiple conductive pads 108 upon front surface 107), double-sided (multiple conductive pads 108 upon both front surface 107 and rear surface 109). One or more conductive pads 108 are electrically connected to one or more traces 114. For example, a single conductive trace 114 is both electrically and mechanically connected to a single conductive pad 108.

PRCE connector 150 includes PR connector 148 and the edge connector of PCB 102. PR connector 148 includes a receptacle portion 154 and a mount region 152. Mount region 152 includes a mount surface 153 that is mechanically and electrically connected to PCB 102. For example, as depicted, mount surface 153 is mechanically and electrically connected to front surface 107 of PCB 102. Mount surface 153 may include conductive pads or a pin grid in a shape designed to match a corresponding conductor interconnect upon the PCB 102. These electronic features on the PCB 102 and upon the mount surface 153 may provide both electrical and mechanical connection between PR connector 148 and PCB 102. Mount surface 153 has an area sufficient to mechanically bond with PCB 102 to absorb moments, or rotating forces, at such junction that may be created in the process of seating of PR connector 148 with an associated PCER connector 200, exemplarily shown in FIG. 4.

Receptacle portion 154 includes a plurality of pin receptacles 156 therewithin. Pin receptacles 156 are open at a bottom surface 155 of PR connector 148 and shaped to receive a pin of PCER connector 200. Pin receptacles 156 may be arranged in a pin grid of rows and columns. An inner surface of pin receptacle 156 may be electrically conductive and is further referred to herein as conductive pin receptacle 158. Conductive pin receptacle 158 is shaped to electrically and mechanically connect with the received pin. One or more conductive pin receptacle 158 are electrically connected to one or more internal electrical pathways 160 within PCER connector 200. The internal electrical pathway 160 is further connected to a conductive pad or pin upon mount surface 153. For clarity, an electrical pathway is formed between conductive pin receptacle 158 and trace 114. As such, an electrical pathway is formed between conductive pin receptacle 158 and an electrical component on PCB, such as processor 110. For example, a single conductive trace 114 is both electrically and mechanically connected to a single conductive pad 108.

PR connector 148 may have a front surface 151, mount surface 153, rear surface 153.1 of receptacle portion 154, bottom surface 155 of receptacle portion 154, bottom surface 155.1 of mount portion 152, side surface 157, and/or side surface 159.

Side surface 157 may be coplanar, inset, or the like relative to side surface 103 of PCB 102. Similarly, side surface 159 may be coplanar, inset, or the like relative to side surface 105 of PCB 102.

Edge connector region 106 may be located entirely between bottom surface 155.1 of mount portion 152 and bottom surface 155 of receptacle portion 154. For example, conductive pads 108 and/or bottom edge surface 111 may be located between bottom surface 155.1 of mount portion 152 and bottom surface 155 of receptacle portion 154. Clearance 170 between conductive pads 108 and rear surface 153.1 of receptacle portion 154 may allow clearance or open space for a socket wall of PCER connector 200 to fit therebetween and allow for a pad 222 thereof, shown in FIG. 4, to connect with a pad 108, e.g., on the front surface 107, of the edge connector of PCB 102.

Bottom surface 155.1 of mount portion 152 and/or bottom surface 155 of receptacle portion 154 may be parallel with the xz plane, rear surface 153.1 of receptacle portion 154 may be parallel with the yz plane, and front surface 151 may be parallel with the xy plane. When connected, mount surface 153 may be about or substantially coincident with e.g., front surface 107 of PCB 102, as depicted.

Pin receptacle 156 and conductive pin receptacle 158 may be positioned generally vertically in that the z-axis diameter of pin receptacle 156 and conductive pin receptacle 158 is smaller than the y-axis height thereof. Similarly, pad 108 may also be positioned generally vertically in that the x-axis width of pad 108 is smaller than the y-axis height thereof.

Figure 4:
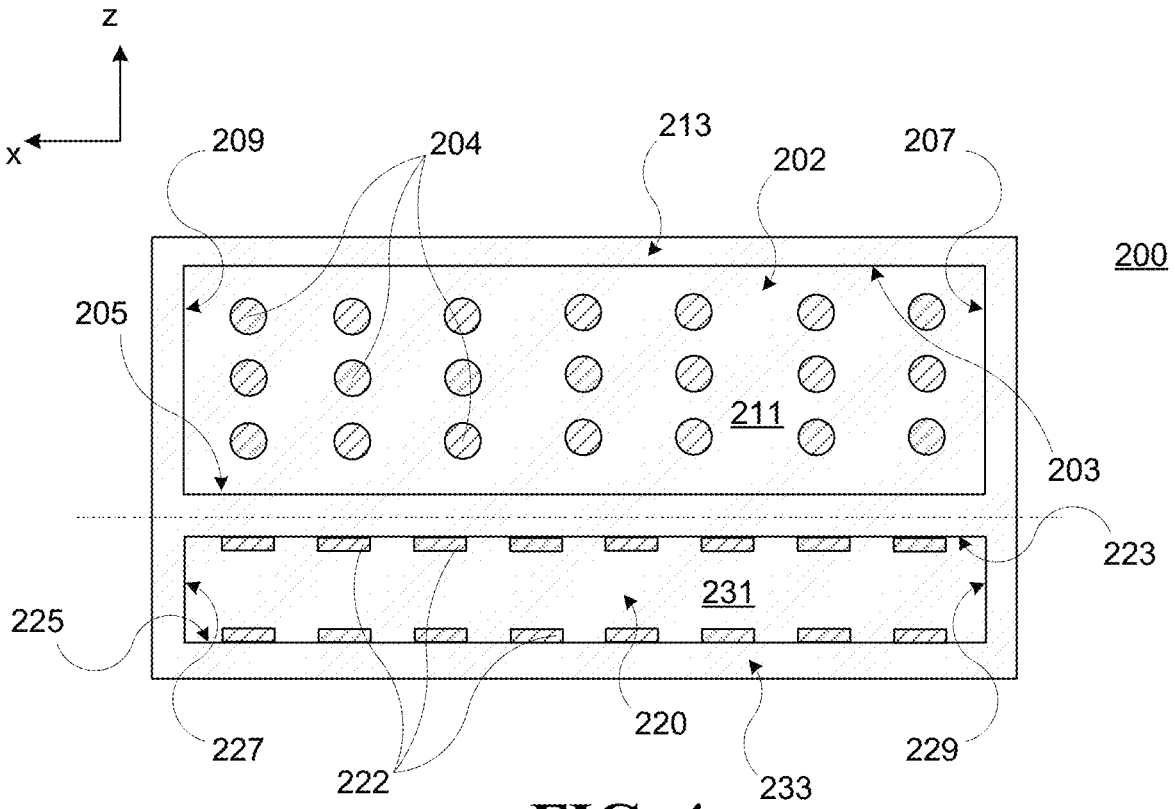
FIG. 4 depicts a planar view of a PCER connector, according to one or more embodiments of the present invention.
Figure 6:
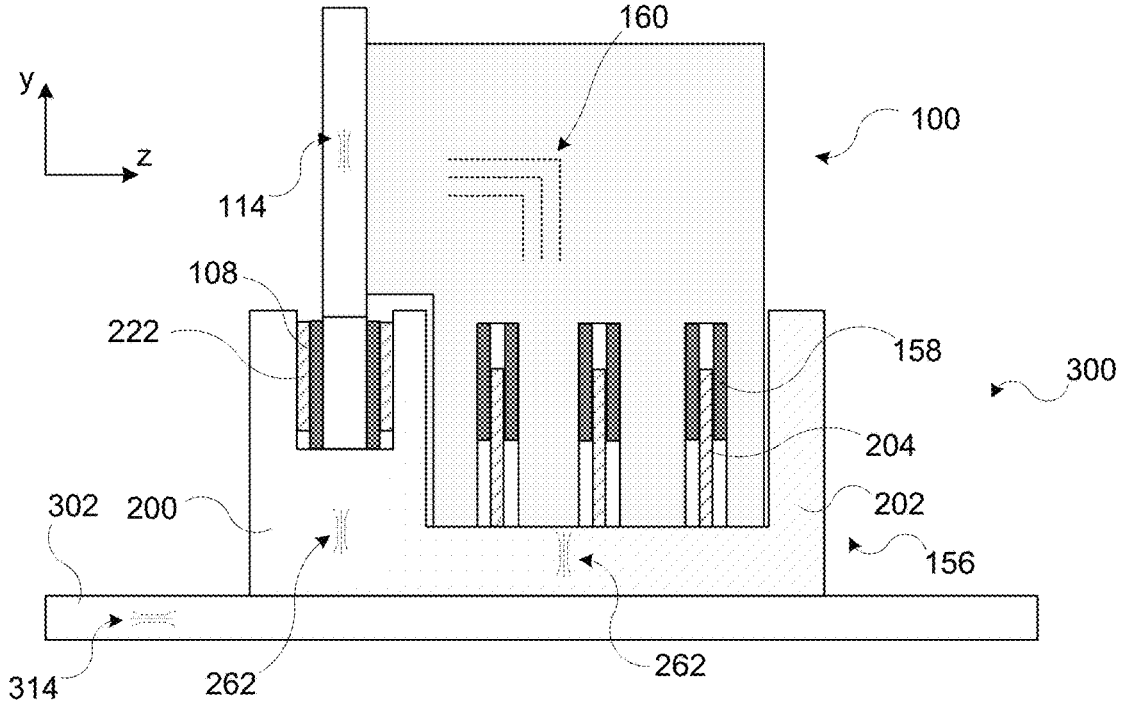
FIG. 6 depicts a cross sectional planar view of a PCER connector connected to a PRCE connector, according to one or more embodiments of the present invention.

FIG. 4 depicts a planar view of PCER connector 200, according to one or more embodiments of the present invention. PCER connector 200 includes a pin socket region 202 and an edge socket region 220. Pin socket region 202 may include rear surface 203, pins 204, front surface 205, side surface 207, side surface 209, bottom surface 211, top surface 213, and internal traces 262, as depicted in FIG. 6.

Pins 204 are electrically conductive and may extend from bottom surface 211. Pins 204 may be arranged in a pin grid of columns and rows. Each pin 204 may be located along a y-axis within pin socket region 202 to be aligned with each associated y-axis with a different receptacle 156 of PR connector 148. When PRCE connector 150 is seated to PCER connector 200, each pin 204 may be directly connected to an aligned conductive pin receptacle 158. One or more pins 204 may be connected or directly connected to one or more internal traces 262.

Figure 5:
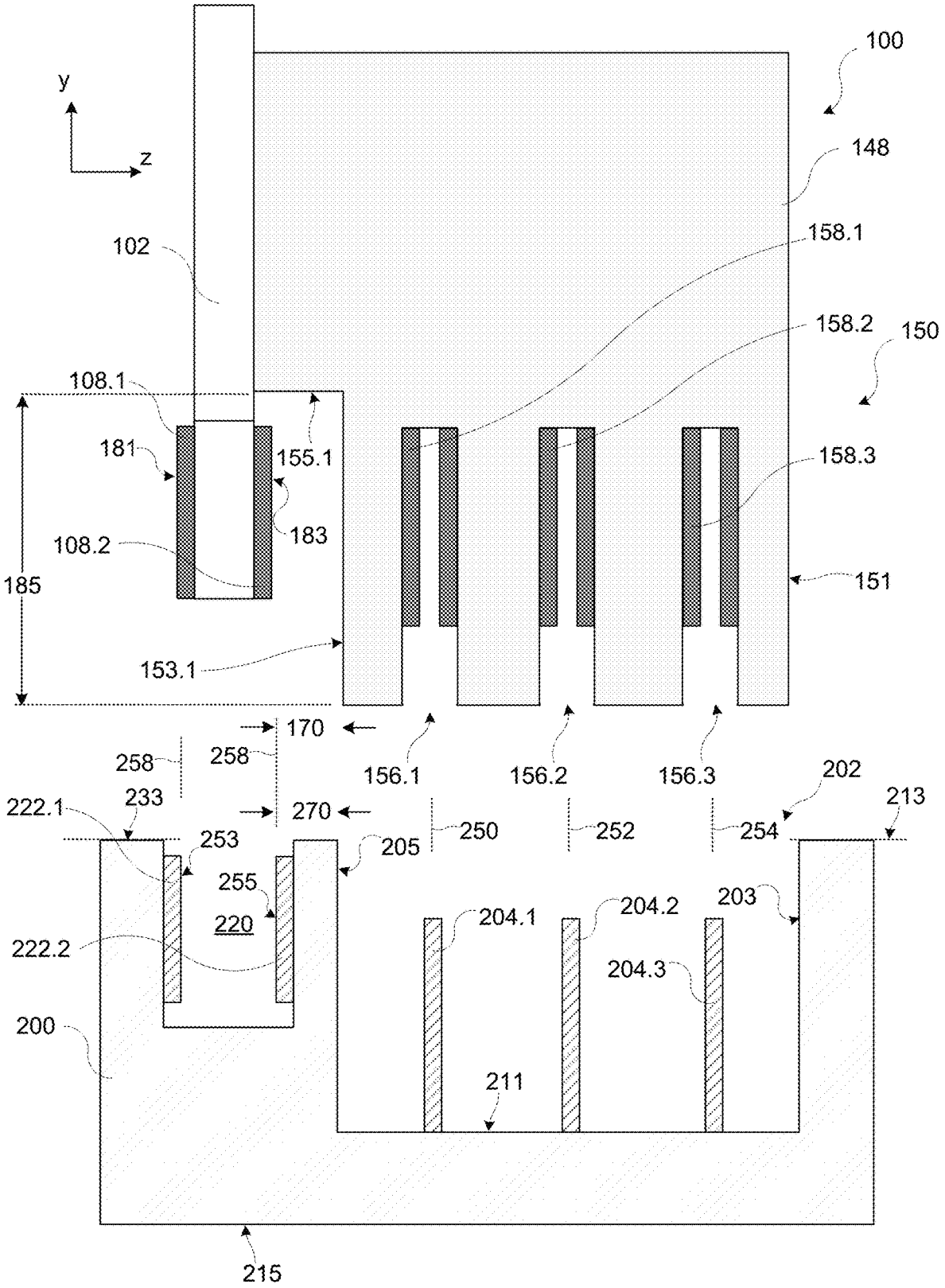
FIG. 5 depicts a cross sectional planar view of a PCER connector in relation to a PRCE connector, according to one or more embodiments of the present invention.

PCER connector 200 may further include mount surface 215, exemplary shown in FIG. 5. Mount surface 215 may include conductive pads or a pin grid in a shape designed to match a corresponding conductor interconnect upon a PCB 302, exemplary shown in FIG. 6. Each internal trace 262 may be connected or directly connected to one or more internal traces 262. The electronic features on the PCB 302 and upon the mount surface 215 may provide both electrical and mechanical connection between PCER connector 200 and PCB 302. In an embodiment, PCB 302 may be a backplane, motherboard, system board, or the like.

The xz dimensions of receptacle portion 154 are chosen to generally fit and guide receptacle portion 154 into pin socket region 202. For example, the dimension between side surfaces 157, 159 and the dimension between front surface 151 and rear surface 153.1 may be slightly less than the dimension between side surface 207, 209 and the respective dimension between rear surface 203 and front surface 205, respectively. Such relationship between the receptacle portion 154 and pin socket region 202 allows the receptacle portion 154 to be located within and guided generally along the y-axis within the pin socket region 202, prior to the wiping, or connection, of pin 204 against an aligned conductive pin receptacle 158.

Edge socket region 220 may include pads 222, rear surface 223, front surface 225, side surface 227, side surface 229, bottom surface 231, and top surface 233.

Pads 222 are electrically conductive and may extend from rear surface 223 and/or front surface 225. Pad 222 may be located along edge socket region 220 to be substantially aligned with a pad 108 of the edge connector of PCB 102, such that when PRCE connector 150 is seated to PCER connector 200, each pad 108 is directly connected to an associated and aligned pad 222.

The xz dimensions of the edge connector of PCB 102 are chosen to generally fit and guide the edge connector into edge socket region 220. For example, the dimension between side surfaces 103, 105 may be slightly less than the dimension between side surface 227, 229. Similarly, the dimension between front and rear surfaces of pads 108 may be the same or substantially the same as the dimension between pads 222 on rear surface 223 and pads 222 on front surface 225. This relationship between the edge connector and edge socket region 220 allows the edge connector to be located, and guided generally along the y-axis, within the edge socket region 220, prior to the wiping, or connection, of pads 108 against the aligned PRCE connector 150.

A pin socket region 202 opening to the internal socket thereof allows for receptacle portion 154 to be inserted into the pin socket region 202 and generally fit within or internal to the surfaces 203, 205, 207, and 209. Similarly, an edge socket region 220 opening to the internal socket thereof allows for edge connector of PCB 102 within edge connector region 106 to be inserted into the edge socket region 220 and generally fit within or internal to the pads 222 upon surfaces 223, 225, and fit within or internal to the surfaces 227, 209. Pin socket region 202 socket opening and edge socket region 220 socket opening may generally lay within a same or different xz plane.

Surface 203, 205, 223, and 225 may be substantially parallel along respective yz planes. Surface 207, 209, 227, and 229 may be substantially parallel along respective xy planes. Surface 207 and surface 229 may be coplanar and surface 209 and surface 227 may be coplanar. The coplanarity of surface 207, 229 and surface 209, 227 may result from planar surfaces 105, 159 and side surfaces 103, 157 which may be chosen to maximize the x-axis dimensions the edge connector and the PR connector 148 to maximize communication throughput therethrough to PCER connector 200.

FIG. 5 depicts a cross sectional planar view of PCER connector 200 in alignment with PRCE connector 150, according to one or more embodiments of the present invention. Prior to seating PRCE connector 150 within PCER connector 200, PRCE connector 150 may be aligned against PCER connector 200.

PRCE connector 150 may be aligned against PCER connector 200 by positioning pin receptacle 156.1 and associated conductive pin receptacle 158.1 in relation to pin 204.1 so that they share the same central y-axis 250, by positioning pin receptacle 156.2 and associated conductive pin receptacle 158.2 in relation to pin 204.2 so that they share the same central y-axis 252, and by positioning pin receptacle 156.3 and associated conductive pin receptacle 158.3 in relation to pin 204.3 so that they share the same central y-axis 254.

PRCE connector 150 may be aligned against PCER connector 200 by positioning outside surface 181 of pad 108.1 in relation to inside surface 253 of pad 222.1 so that they share the same xy plane 256 and by positioning outside surface 183 of pad 108.2 in relation to inside surface 255 of pad 222.2 so that they share the same xy plane 258.

Y-axis 250, 252, 254 and xy plane 256, 258 may all be parallel.

A z-axis clearance 170 between conductive pad(s) 108.2 and rear surface 153.1 may provide open space for a width 270 of a socket wall (i.e., the structure including and between surface 255 of pad(s) 222.2 and front surface 205 of pin socket region 202) to fit or otherwise to be inserted and juxtaposed therebetween or therewithin. Further, a y-axis clearance 185 that separates bottom surface 155 of PR connector 148 and bottom surface 155.1 of mount portion 152 may provide open space for the socket wall of PCER connector 200 including and between top surface 233 and bottom surface 231 of edge socket region 220 to fit therebetween.

In an exemplary implementation, the relative y-axis positional relationships between pads 108 and pads 222 and between conductive pin receptacles 158 and pins 204 may be chosen to result, when PRCE connector 150 is seated to PCER connector 200, in pads 108 directly contacting pads 222 before or prior to when pin receptacles 158 directly contact pins 204. Alternatively, the relative y-axis positional relationships between pads 108 and pads 222 and between conductive pin receptacles 158 and pins 204 may result, when PRCE connector 150 is seated to PCER connector 200, in pads 108 directly contacting pads 222 after or subsequent to when pin receptacles 158 directly contact pins 204. Similarly, the relative y-axis positional relationships between pads 108 and pads 222 and between conductive pin receptacles 158 and pins 204 may result, when PRCE connector 150 is seated to PCER connector 200, in pads 108 directly contacting pads 222 simultaneously relative to when pin receptacles 158 directly contact pins 204.

FIG. 6 depicts a cross sectional planar view of PCER connector 200 seated or connected with PRCE connector 150, according to one or more embodiments of the present invention. Also depicted is an electrical system 300 that includes PCER connector 200 and printed circuit board 302, hereinafter referred to as PCB 302, according to one or more embodiments of the present invention.

Pin socket region 202 may further include internal traces 262. Each internal trace 262 is internal or inside the perimeter surfaces of PCER connector 200 and may be directly connected to one or more pads 222. Each trace 262 may further be connected or directly connected to the conductive pads, pins, or other conductive interconnect features on mount surface 215 of PCER connector 200. Similarly, edge socket region 220 may further include internal traces 262 Each internal trace 262 is internal or inside the perimeter surfaces of PCER connector 200 and may be directly connected to one or more pins 204. Each trace 260 may further be connected or directly connected to the conductive pads, pins, or other conductive interconnect features on mount surface 215 of PCER connector 200.

Mount surface 215 may include conductive pads, pin grid, or other interconnects in a shape designed to match a corresponding conductor interconnect upon a PCB 302. These electronic features on the PCB 302 and upon the mount surface 215 may provide both electrical and mechanical connection between PCER connector 200 and PCB 302. A first electrical pathway may be formed between an internal trace 262 and a trace 314 across mount surface 215 and a second electrical pathway may be formed between an internal trace 262 and a trace 314 across mount surface 215. As such, an electrical pathway may be formed through PCER connector 200 from trace 114, through internal electrical pathway 160, through pad 222 to a trace 314 and an electrical pathway may be formed through PCER connector 200 from trace 114, through internal electrical pathway 160, through pin 204 to a trace 314.

Figure 7:
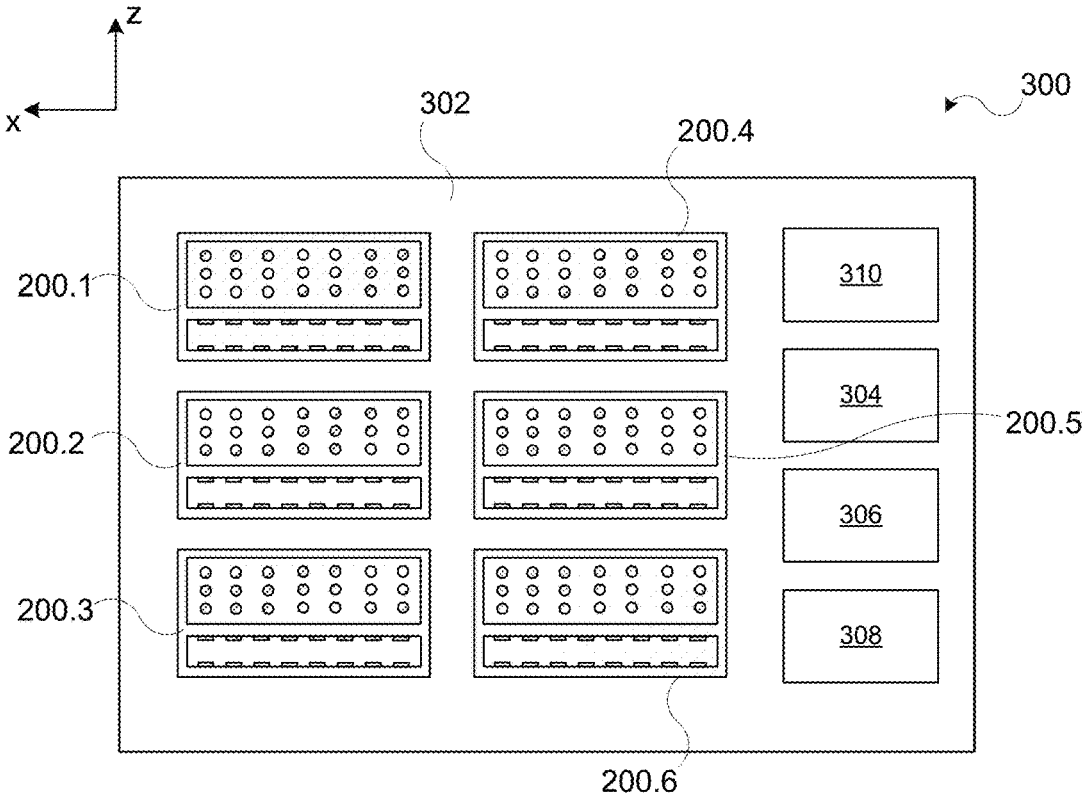
FIG. 7 depicts a planar view of an electrical system that includes one or more PCER connectors, according to one or more embodiments of the present invention.

FIG. 7 depicts a planar view of an electronic system 300 that includes of PCB 302 with one or more PCER connectors 200, according to one or more embodiments of the present invention.

PCB 302 is a printed circuit card, as is known in the art, and may include alternating conductive layers and insulating layers. Electronic components, such as a processor 304, storage 306, network interface card 308, and/or cooling system 310, may be connected to PCB 302. For example, respective terminal(s) of the electronic components may be soldered to respective conductive pads of the PCB 302, respective terminal(s) of the electronic components may be plugged into appropriate connects of the PCB 302, or the like. Electrical connections and/or open circuits between the electronic component's terminals are provided by traces 314. For example, one or more traces 314 may electrically connect appropriate landing pads associated with a first electronic system 100 plugged into PCER connector 200.1 with appropriate landing pads associated with a second electronic system 100 plugged into PCER connector 200.2. Trace(s) 314 may be located on the surface of an outer insulating layer, on the surface of an internal insulating layer, etc.

Traces 314 of a particular conductive pathway layer may be a pattern of conductors, similar to wires on a surface, that provides electrical connections on that conductive layer. For adequate electrical isolation, traces 314 formed in the same conductive layer may be spaced apart. The insulating layer(s) between different conductive layers may adequately electrically isolate the conductive layers. Vias, or plated-through holes that extend through one or more appropriate insulating layers, may electrically connect a trace 314 of a first conductive layer with a trace 314 of a different conductive layer.

PCB 302 may mechanically support the electronic components using conductive pads in a shape designed to accept the component's terminals and also electrically connect them using traces 314, conductive planes (voltage plane, etc.), and/or other features etched from an appropriate conductive layer. These electronic components may be soldered, plugged, etc. to the PCB 302 to provide both electrical and mechanical connection. PCB 302 can be single-sided, double-sided, or multi-layer.

For clarity, various electrical pathways may be formed between the electrical components of the first electronic system, such as processor 110, memory 112, or the like, to the electrical components of the second electronic system, such as processor 304, storage 306, network interface card 308, and/or cooling system 310 of the second electronic system 300. For example, processor 110 may be connected to processor 304 by way of trace 114, pad 108, pad 222, trace 262, and trace 316, etc., memory 112 may be connected to processor 304 by way of trace 114, internal electrical pathway 160, conductive pin receptacle 158, pin 204, trace 262, and trace 316.

Figure 8:
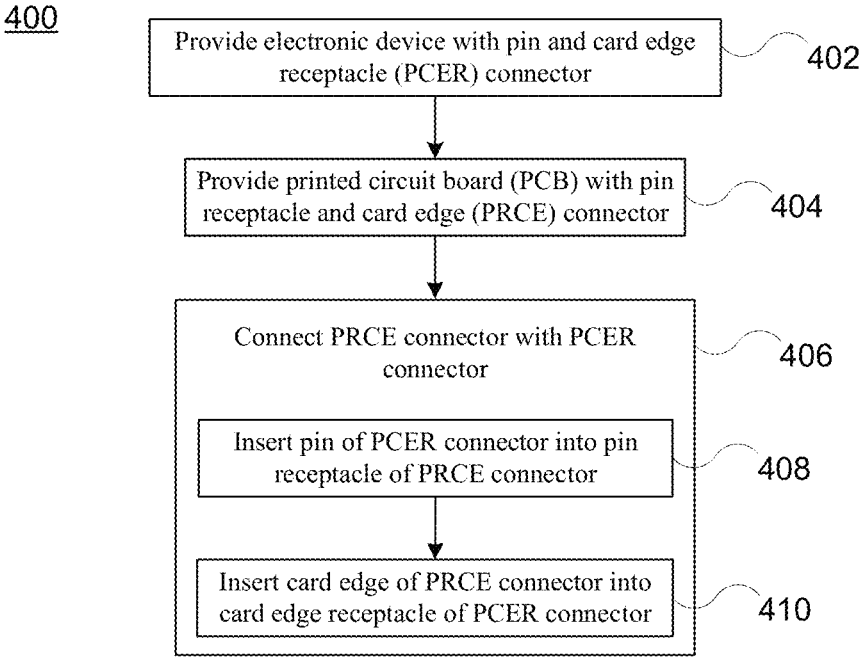
FIG. 8 depicts an exemplary method of connecting a PCER connector with a PRCE connector, according to one or more embodiments of the present invention.

FIG. 8 depicts an exemplary method 400 of connecting PRCE connector 150 with PCER connector 200, according to one or more embodiments of the present invention. Method 400 may begin, at block 402, with providing electronic system 300 that includes a PCER connector 200.

Method 400 may continue, at block 404, with providing electronic system 100 that includes PRCE connector 150.

Method 400 may continue, at block 406, with connecting or seating the PRCE connector 150 with PCER connector 200. The connection of PRCE connector 150 with PCER connector 200 may occur as a result of aligning the PRCE connector 150 with PCER connector 200 and moving the electronic system 100 toward the electronic system 300 along a y-axis. For example, PRCE connector 150 may be aligned against PCER connector 200 by positioning pin receptacle 156.1 and associated conductive pin receptacle 158.1 in relation to pin 204.1 so that they share the same central y-axis 250, by positioning pin receptacle 156.2 and associated conductive pin receptacle 158.2 in relation to pin 204.2 so that they share the same central y-axis 252, and by positioning pin receptacle 156.3 and associated conductive pin receptacle 158.3 in relation to pin 204.3 so that they share the same central y-axis 254. Further, connecting the PRCE connector 150 with PCER connector 200 may occur by moving the electronic system 100 toward the electronic system 300 along parallel y-axes' 250, 252, 254, etc. until pins 204 are connected, or wiped to a predetermined dimension, against conductive pin receptacle 158 (block 408) and until pad(s) 108 of the card edge connector of PCB 102 are connected, or wiped to a predetermined dimension, against pad(s) 222 (block 410).

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The drawings may depict various denoted planar views of the certain features of the embodiments. The planar views are shown in an xy plane, xz plane, and/or a xy plane, which are orthogonal planes with respect thereto.

For the sake of brevity, conventional techniques related to making and using aspects of the invention may or may not be described in detail herein. Various aspects of computing systems and specific computer programs to implement the various technical features described herein are well known. Accordingly, in the interest of brevity, many conventional implementation details are only mentioned briefly herein or are omitted entirely without providing the well-known system and/or process details.

The terminology used herein is for the purpose of describing embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The diagrams depicted herein are illustrative. There can be many variations to the diagram, or the steps (or operations) described therein without departing from the spirit of the disclosure. For instance, the actions can be performed in a differing order or actions can be added, deleted, or modified. Also, the term "coupled" describes having a signal path between two elements and does not imply a direct connection between the elements with no intervening elements/connections therebetween. All these variations are considered a part of the present disclosure.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e., one, two, three, four, etc. The terms "a plurality" are understood to include any integer number greater than or equal to two, i.e., two, three, four, five, etc. The term "connection" can include both an indirect "connection" and a direct "connection."

The terms "about," "substantially," "approximately," and variations thereof, are intended to include the degree of error associated with measurement of the quantity based upon the equipment available at the time of filing the application. For example, "about" can include a range of ±8% or 5%, or 2% of a given value.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A system comprising:

a first printed circuit board comprising an edge connector comprising a plurality of edge connector pads;

a pin receptacle connector comprising a mount region connected to the printed circuit board and a receptacle portion comprising a plurality of conductive pin receptacles;

a clearance between the edge connector and the receptacle portion; and a pin and card edge receptacle connector comprising an edge socket that receives the edge connector and comprises a plurality of socket pads, the pin and card edge receptacle connector further comprising a pin socket that receives the receptacle portion and comprises a plurality of pins.

2. The system of claim 1, wherein the plurality of socket pads are directly upon an inner front surface and inner rear surface of the edge socket and wherein the plurality of pins extend from a bottom surface of the pin socket.

3. The system of claim 1, wherein the pin and card edge receptacle connector comprises a mount surface connected to a second printed circuit board.

4. The system of claim 1, wherein a first sidewall of the first printed circuit board is inset from a first sidewall of the edge connector and wherein a second sidewall of the first printed circuit board is inset from a second sidewall of the edge connector.

5. The system of claim 1, wherein a first sidewall of the first printed circuit board is coplanar with a first sidewall of the edge connector and wherein a second sidewall of the first printed circuit board is coplanar with a second sidewall of the edge connector.

6. The system of claim 5, wherein a first sidewall of the edge socket is coplanar with a first sidewall of the pin socket and wherein a second sidewall of the edge socket is coplanar with a second sidewall of the pin socket.

7. The system of claim 1, wherein each pin of the plurality of pins directly contacts a different conductive pin receptacle of the plurality of conductive pin receptacles.

8. The system of claim 7, wherein each edge connector pad of the plurality of edge connector pads directly contacts a different socket pad of the plurality socket pads.

9. The system of claim 8, wherein the pin and card edge receptacle connector further comprises a wall between the edge socket and the pin socket.

10. The system of claim 9, wherein a width of the wall is less than an associated width of the clearance.

11. The system of claim 10, wherein the wall is between the edge connector and the receptacle portion within the clearance.

12. The system of claim 1, wherein the first printed circuit board comprises a first trace connected to an edge pad of the plurality of edge connector pads and a second trace connected to a conductive pin receptacle of the plurality of conductive pin receptacles by an electrical pathway within the pin and card edge receptacle connector.

13. The system of claim 12, wherein the electrical pathway is further connected to the conductive pin receptacle of the plurality of conductive pin receptacles.

14. The system of claim 13, wherein the electrical pathway is further connected to a pin of the plurality of pins.

15. The system of claim 14, wherein the electrical pathway is further connected to a trace of the second printed circuit board.

16. A system comprising:

a first printed circuit board system communicatively connected to a second printed circuit board;

the first printed circuit board comprising an edge connector comprising a plurality of edge connector pads, a pin receptacle connector comprising a mount region connected to the printed circuit board and a receptacle portion comprising a plurality of conductive pin receptacles, and a clearance between the edge connector and the receptacle portion; and the second printed circuit board comprising a pin and card edge receptacle connector comprising an edge socket that receives the edge connector and comprises a plurality of socket pads, the pin and card edge receptacle connector further comprising a pin socket that receives the receptacle portion and comprises a plurality of pins.

17. The system of claim 16, wherein the plurality of socket pads are directly upon an inner front surface and inner rear surface of the edge socket and wherein the plurality of pins extend from a bottom surface of the pin socket.

18. The system of claim 16, wherein each pin of the plurality of pins directly contacts a different conductive pin receptacle of the plurality of conductive pin receptacles.

19. The system of claim 18, wherein each edge connector pad of the plurality of edge connector pads directly contacts a different socket pad of the plurality of plurality of socket pads.

20. A computer comprising:

a daughter printed circuit card communicatively connected to a mother board;

the daughter printed circuit card comprising an edge connector with a plurality of edge connector pads, a pin receptacle connector comprising a mount region connected to the printed circuit board and a receptacle portion comprising a plurality of conductive pin receptacles, and a clearance between the edge connector and the receptacle portion; and the mother board comprising a pin and card edge receptacle connector comprising an edge socket that receives the edge connector and comprises a plurality of socket pads, the pin and card edge receptacle connector further comprising a pin socket that receives the receptacle portion and comprises a plurality of pins.

* * * * *